United States Patent [19]

Wertz et al.

[11] Patent Number: 4,856,134

[45] Date of Patent: Aug. 15, 1989

[54] ABRASIVE PAD, WHICH CAN SUBSTITUTE FOR A STEEL WOOL PAD, AND/OR SCOURING PAD AND PROCESS FOR PRODUCING SAME

[75] Inventors: Jean-Luc Wertz, Beauvais; Jacques Baudonnel, Ons-en-Bray, both of France

[73] Assignee: Societe Anonyme: SPONTEX, Paris Cedex, France

[21] Appl. No.: 159,707

[22] Filed: Feb. 24, 1988

[30] Foreign Application Priority Data

Jan. 27, 1988 [FR] France ..... 88 00947

[51] Int. Cl.[4] ..... A47L 17/08

[52] U.S. Cl. ..... 15/104.93; 15/105; 15/118; 15/209 B; 51/402; 51/407; 156/213; 156/250

[58] Field of Search ..... 15/105, 118, 209 R, 15/209 B, 244.3, 244.4, 104.93, 104.94; 156/213, 250; 51/402, 407

[56] References Cited

U.S. PATENT DOCUMENTS

| | | | |
|---|---|---|---|
| 3,038,187 | 6/1962 | Nathanson | 15/209 B |
| 3,040,353 | 6/1962 | Gray | 15/244.3 |
| 3,638,270 | 2/1972 | Schlegel et al. | 15/244.3 |
| 3,849,225 | 11/1974 | Haertle | 15/244.3 |

FOREIGN PATENT DOCUMENTS

| | | | |
|---|---|---|---|
| 2063058 | 6/1981 | United Kingdom | 15/244.3 |

*Primary Examiner*—Edward L. Roberts

*Attorney, Agent, or Firm*—Roberts, Spiecens & Cohen

[57] ABSTRACT

A pad which can be abrasive, scouring or both, is formed as a block of foam between two nonwovens. The foam is a polyurethane foam and the nonwovens are based on a mixture of polyamide and polyester fibers. The polyamide fibers have physical properties similar to those of the polyurethane foam. The nonwovens and the foam block are bonded together at their periphery by thermal-welding. The pad can be coated with abrasive fillers. It can also be used for scouring delicate surfaces when it contains little or no abrasive fillers.

15 Claims, 1 Drawing Sheet

ABRASIVE PAD, WHICH CAN SUBSTITUTE FOR A STEEL WOOL PAD, AND/OR SCOURING PAD AND PROCESS FOR PRODUCING SAME

FIELD OF THE INVENTION

The present invention relates to the field of cleaning in general and more particularly to an abrasive pad, substitute for steel wool, and/or a scouring pad. The invention also relates to a process for obtaining such pad.

BACKGROUND OF THE INVENTION

Steel wool has been used for a long time now in pad form for scouring kitchen utensils such as cooking pots and pans.

These steel wool pads, however, have the disadvantage of rusting, of disintegrating quickly, and of being difficult to clean. Moreover, they are unpleasant to the touch.

SUMMARY OF THE INVENTION

It is one object of the present invention to provide a pad which is abrasive on both faces and which constitutes a substitute for steel wool, without any of its disadvantages, and which, in particular, will last longer, while preserving its original aspect and properties.

The invention also provides scouring or mixed pads, i.e. pads that are scouring on one face and abrasive on the other.

The abrasive and/or scouring pad according to the invention is composed of a block of foam between two nonwovens. The term "non woven" is used in the art to refer to sheets or webs composed of materials which are bonded together and not woven. Its characteristics are as follows :

the foam is a polyurethane foam;

the nonwovens are based on a mixture of polyamide and polyester fibers, the polyamide having physical properties similar to those of said polyurethane foam;

said nonwovens and foam are bonded together at their periphery by thermal-welding.

The specific nature of the materials composing the pad according to the invention gives it advantageous properties as regards its cleaning and scouring action, with the added possibility for said pad of being produced by thermal-welding (or thermal-sealing), which is a very reliable method. Indeed, the thermal-welding produced with such material is strong, non-brittle and has no sharp edges, nor has it any tendency to break off.

DETAILED DESCRIPTION

Figure 1:
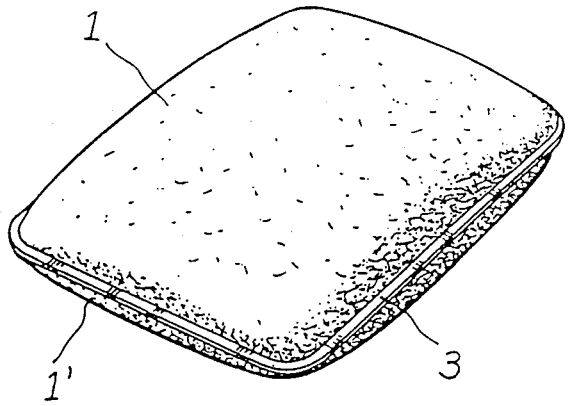
FIG. 1 is a perspective view of a pad according to the invention.
Figure 2:
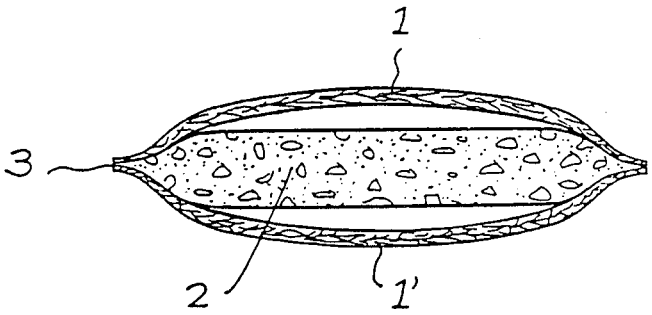
FIG. 2 is a cross-sectional view through the pad.

In the drawing is seen a pad composed of a block of foam 2 between two non woven webs 1,1' and bonded together at the periphery of the pad at 3, for example, by thermal welding. Hereafter, the webs 1,1' will be referred to as nonwovens.

The foam 2 used in the pad according to the invention is a polyurethane foam whose composition is based on polyols and isocyanates. Said foam is stabilized inside the pad body since bonded to the two nonwovens 1,1' over its periphery.

Suitable nonwovens according to the invention are webs containing a mixture of polyamide/polyester fibers. Polyamide has physical properties —bonding temperature, melting point— similar to those of the polyurethane foam used.

The fibers composing the nonwovens have been selected, according to the invention, for their mechanical properties —resistance to abrasion, mechanical strength— and for their physical characteristics —heat-fisibility—. Said fibers are polyamide and polyester fibers.

Polyamide fibers exhibit a good resistance to abrasion and a good mechanical resistance. Polyester fibers also exhibit a good resistance to abrasion with a high mechanical resistance. The fibers selected according to the invention preferably have a unit weight less than 50 dtex. The term "weight" of a fiber is used to mean "mass per unit length" and is measured in decitex (grams per 10,000 meters). Such fibers have a good covering rate and produce supple nonwovens which are not unpleasant to the touch.

For practical reasons, the usable polyamide fibers generally have a unit weight ranging between 0.7 and 44 dtex, and the polyester fibers a unit weight ranging between 4.4 and 40 dtex.

The physical properties of these fibers are fundamental. They enable the formation by thermal-welding of a supple bond on the periphery of the pad.

Polyamide, which has the lowest transformation temperatures —bonding temperature, melting point— is used as a bonding agent. Said transformation temperatures are close to those of the polyurethane foam.

Therefore, a heating to the adequate temperature, during the welding operation causes the formation of an intimate "liquid" mixture of polyamide and polyurethane, within which mixture the polyester fibers begin to soften. Indeed, the polyester fibers are more heat-resistant than the polyamide fibers. It is then possible to obtain a reliable bond, which has a certain suppleness and also enables the stabilization of the foam inside the pad.

According to the invention, the materials are judiciously selected : polyamide. polyester polyurethane foam. The combination of these materials, by a simple technique, gives abrasive and/or scouring pads of high performance.

Advantageously, the nonwovens are based on a mixture containing 50 to 90% by weight of polyamide fibers and 50 to 10% by weight of polyester fibers. The quantities of polyamide and polyester used can indeed be optimized, as a function of the target results, in particular where the bonding is concerned.

On this point, it has been found that polyamide acts as a bonding agent and polyester as a supplying agent.

Preferably, the nonwovens are based on a mixture containing about 80% by weight of polyamide fibers and about 20% by weight of polyester fibers.

Regarding the fibers used, the Applicant has also shown the advantage that there is in using, in the proportions by weight indicated above, polyester fibers of low unit weight and/or mixtures of polyester fibers, and more particularly polyamide fibers, of different unit weights.

When using polyester fibers of low unit weight, a greater quantity of fibers is used giving then a very special homogeneousness and a remarkable suppleness of the material throughout its surface and also in the welding. For example, polyester fibers of unit weight ranging between 4.4 and 17 dtex, ends included, are advantageously used.

Similarly, by mixing polyamide fibers of at least two different weights, it is possible —the bonding factor at joint level being identical— to improve the surface condition of the pad.

Advantageously, fibers in polyamide 6 are used in the nonwovens of the pads according to the invention. However, other polyamide fibers may also be used. It is necessary, as indicated hereinabove, that the polyamide used has similar physical properties to those of the selected polyurethane foam.

It is specified, by way of indication, that the nonwovens contained in the pads according to the invention, can advantageously be based on a mixture of :

20% by weight of fibers of polyamide 6 of 44 dtex,
60% by weight of fibers in polyamide 6 of 22 dtex,
20% by weight of polyester fibers of 17 dtex.

The nonwovens constituting the faces of the pads according to the invention, based on the above-referred mixtures of fibers, are pre-bonded mechanically before being chemically-bonded, preferably with a synthetic latex such as, for example, a thermal-setting latex.

Said chemical binder is designed to give to the mixture of fibers a fairly high internal cohesion without however causing obstruction in the welding plane, during the thermal-welding operation. The quantity used, therefore, should be controlled. The weight of binder deposited with respect of the weight of fibers should be between 0.2 and 0.6. Said weight generally varies between 10 and 60 $g/m_2$ (in dry weight).

A bonded web of fibers is thus obtained after heating.

Said web can be used as is, to constitute the faces of a scouring pad according to the invention. It is however, generally preferred to subject it to a further treatment, i.e. to a spraying of a formulation, possibly containing abrasive fillers. Such formulation is normally based on a synthetic latex : phenolic resin or acrylic latex.

This spraying, which is quite controlled, can only be applied to one face of the nonwoven, i.e. the face intended to constitute the outer surface of the pad. Also, assuming that the formulation contains abrasive fillers, it is important that it should not penetrate deeply into the nonwoven. Both these conditions should be met in order to obtain a reliable and regular welding at the periphery of the pad.

Whether or not abrasives are used, in great or small quantities, and composed of more or less hard materials, depends obviously on the properties required for the pad, and more precisely for each face of the pad according to the invention.

The pads according to the invention can, indeed, have either two abrasive faces, or only one abrasive face or no abrasive face. It is merely a question of using nonwovens having on one of their faces the required surface condition.

The pads according to the invention, with abrasive fillers, are an advantageous substitute for steel wool.

The pads according to the invention, with little or no abrasive fillers, are advantageously used for scouring delicate surfaces.

Examples of suitable abrasive fillers are: silicon carbide, alumina, silica, talc or mixtures thereof.

Such abrasive fillers are deposited on the bonded web in the proportion of about 50 to about 200 $g/m_2$ (dry weight) of the formulation containing them.

It will be recalled that even without such fillers, the nonwovens based on polyamide and polyester fibers, bonded and optionally subjected to a spraying treatment, advantageously constitute either the faces or at least one of the faces of the pad according to the invention.

According to a variant embodiment of the invention, the pad also contains soap.

Advantageously, said soap contained in the pad, is distributed in the polyurethane foam, in solid form. The solid particles can be of variable granulometry. The pad according to the invention can also be coated on at least one of its outer faces, with a "film" of soap.

The present invention also relates to the process for producing pads such as described hereinabove.

Said process consists :

in producing the nonwoven/foam/nonwoven assembly, in such a way that the abrasive and/or scouring faces of said nonwovens are facing outwardly;
in placing the resulting assembly between the upper and lower molds of a thermoshaping tool;
in thermal-welding the resulting sandwich form at a temperature close to the melting temperatures of the polyurethane foam and of the polyamide fibers;
and finally, in individualizing the resulting pads, by cutting.

The nonwoven are obtained, as described hereinabove, from a web of fibers, pre-bonded mechanically and chemically-bonded preferably by a synthetic latex, and optionally sprayed over with a phenolic resin. Said resin may optionally contain abrasive fillers.

The polyurethane foam is placed between said nonwovens and the resulting assembly is placed between the upper and lower molds of a thermoshaping tool. Said thermoshaping tool is mounted on a press.

The shape of the molds will define the shape of the resulting pads. These can, for example, be in the form of small cushions, or cylinders, etc.

The nonwoven/foam/nonwoven sandwich is thermal-welded and the resulting pads are individualized by cutting.

The thermal-welding operation is carried out at a temperature close to the melting point of the polyurethane foam and of the polyamide fibers.

This creates at the periphery of the pad a zone of intimate mixture of said materials, within which the polyester fibers begin to soften. This compressed zone, when cooled, constitutes the bond between the two faces of the pad. The heating in the thermoshaping tool is obtained by any suitable means, for example by electric elements, heat-carrying fluids, or by micro-waves or high frequency techniques, etc.

The accurate operational conditions of the thermoshaping are obviously dependent on the exact nature of the materials involved and on their thickness. Their optimization is within the scope of any one skilled in the art.

DETAILED DESCRIPTION OF THE INVENTION

The following example is given to illustrate the invention in more detail.

An abrasive pad according to the invention is produced from a web of fibers, comprising :

20% by weight of fibers of polyamide 6 of 44dtex,

60% by weight of fibers in polyamide 6 of 22 dtex,
20% by weight of polyester fibers of 17 dtex.

Said web weighs 90 g/m$^2$. It is impregnated in a bath with a binder -acrylic latex- containing the agents necessary for the use to be made of it.

The dry weight of latex deposited is about 40 g/m$^2$ (the ratio of the weight of latex deposited to the weight of fibers is around 0.50).

The impregnated web is dried in two ovens successively, the temperature inside these ovens reaching from 50° to 100° C.

The web is then subjected on one of its faces to a spraying operation, with a solution of phenolic resin containing a mixture of silica and alumina. In this solution, the filler/binder ratio is equal to 3. The quantity of dry product sprayed on the web is about 150 g/m$^2$. After drying, said web can be cut to the required dimensions. The web then weighs about 280 g/m$^2$, and its thickness is about 6.6 mm.

The process used for producing a pad according to the invention consists in making a sandwich by inserting a polyurethane foam block between two layers of the aforesaid type. The thickness of the foam block is 8 mm. The sandwich is thermal-welded in the molds of a thermoshaping tool mounted on a press. The essential parameters of this thermal-welding are as follows:

temperature = about 220° C.

Pressure = $15.10^5$ at $2 \cdot 10^6$ Pa (15 to 20 bars)

Time = 1 min.

The thermal-welding temperature corresponds to the start of melting zones of the polyamide 6 and of the polyurethane foam, and to the start of the polyester bonding and softening zone.

The polyester fibers, having reached the softening limit, are bonded under the action of the pressure on their periphery by the polyamide-polyurethane "solution". The resulting bond being then perfectly homogeneous.

The pads are then individualized.

They are characterized by a remarkable efficiency and lasting power. They last for example four times longer than the conventional steel wool pad.

Concerning their abrasive power, this can be measured by the Taber test.

The Taber test is a test for assessing the abrasive power of the nonwovens; such assessment is performed by measuring the loss of weight of aluminum wheels, applied to the nonwoven with a certain pressure (1.5 kg), the nonwoven being imparted with a rotation movement.

The faces of the pad have an abrasive power of 315 mg/1000 turns (initial abrasive power at 50 turns), of 215 mg/1000 turns (abrasive power at 200 turns).

We claim:

1. A pad adapted for abrasive, scouring or both uses comprising a block of foam material, and two nonwoven webs sandwiching said block therebetween, said foam material being a polyurethane foam, said nonwoven webs each comprising a mixture of polyamide and polyester fibers, said polyamide fibers having physical properties similar to those of said polyurethane foam; and a thermally welded joint bonding said nonwoven webs and said foam block together at the periphery thereof.

2. A pad as claimed in claim 1, wherein the polyamide and polyester fibers have a unit weight less than 50 dtex.

3. A pad as claimed in claim 1; wherein the nonwovens webs comprise a mixture of 50 to 90% by weight of polyamide fibers and 50 to 10% by weight of polyester fibers.

4. A pad as claimed in claim 3 wherein the polyamide fibers are present in an amount of 80% by weight and said polyamide fibers are present in amount of 20% by weight.

5. A pad as claimed in claim 1, wherein the polyester fibers have a unit weight between 4.4 and 17 dtex.

6. A pad as claimed in claim 1, wherein the polyamide in the mixture of fibers is polyamide 6.

7. A pad claimed in 6, wherein the nonwoven webs comprise:

20% by weight of fibers of polyamide 6 of 44 dtex,
60% by weight of fibers of polyamide 6 of 22 dtex,
20% by weight of polyester fibers 17 dtex.

8. A pad as claimed in claim 1, wherein the nonwoven webs are pre-bonded mechanically, and chemically bonded by a synthetic latex binder; the ratio of the weight of binder deposited to the weight of fibers being between 0.2 and 0.6.

9. A pad as claimed in claim 8, comprising a spray layer on at least one of said webs containing abrasive fillers.

10. A pad as claimed in claim 1, wherein at least one of the two nonwoven webs includes abrasive fillers on one face constituting an external face of the pad.

11. A pad as claimed in claim 1, wherein the polyurethane foam contains soap.

12. Process for producing a pad as claimed in claim 1, wherein said process comprises:

producing a sandwich assembly of two outer nonwoven webs and an intermediate foam block between the nonwoven webs, such that the faces of the nonwoven webs are facing outwardly;

placing the resulting assembly between upper and lower molds of a thermoshaping tool;

thermal-welding the formed sandwich at a temperature close to the melting temperatures of the polyurethane foam and of the polyamide fibers;

and finally, individualizing the resulting pads, by cutting.

13. A process as claimed in claim 12, wherein the nonwoven webs are formed from a web of fibers, pre-bonded mechanically, and chemically bonded, and on which web has been sprayed a phenolic resin.

14. A process as claimed in claim 13 wherein the nonwoven webs are chemically bonded by a synthetic latex.

15. A process as claimed in claim 13 wherein the phenolic resin sprayed on the web contains abrasive fillers.

* * * * *